US007342216B2

(12) United States Patent
Seifert et al.

(10) Patent No.: US 7,342,216 B2
(45) Date of Patent: Mar. 11, 2008

(54) PHOTOMULTIPLIER SYSTEM AND A MICROSCOPE

(75) Inventors: Roland Seifert, Kassel (DE); Juergen Schneider, Sinsheim (DE)

(73) Assignee: Leica Microsystems CMS GmbH, Wetzlar (DE)

( * ) Notice: Subject to any disclaimer, the term of this patent is extended or adjusted under 35 U.S.C. 154(b) by 60 days.

(21) Appl. No.: 11/359,803

(22) Filed: Feb. 22, 2006

(65) Prior Publication Data

US 2006/0186321 A1 Aug. 24, 2006

Related U.S. Application Data

(60) Provisional application No. 60/771,365, filed on Feb. 8, 2006.

(30) Foreign Application Priority Data

Feb. 23, 2005 (DE) ..... 20 2005 006 695 U
Apr. 26, 2005 (DE) ..... 10 2005 019 647

(51) Int. Cl.
*H01J 43/30* (2006.01)

(52) U.S. Cl. ..... 250/214 VT; 250/207; 313/532

(58) Field of Classification Search ..... 250/207, 250/214 VT; 313/532, 103 R, 103 CM, 313/105 CM, 105 R
See application file for complete search history.

(56) References Cited

U.S. PATENT DOCUMENTS 5,965,982 A * 10/1999 Tachino et al. ..... 313/532

* cited by examiner

*Primary Examiner*—Kevin Pyo
(74) *Attorney, Agent, or Firm*—Darby & Darby

(57) ABSTRACT

A photomultiplier system includes a detector tube, a power supply unit, and a thermal isolation element. The power supply unit provides an accelerating voltage for operating the detector tube. The detector tube and the power supply unit are disposed on different sides of the thermal isolation element.

18 Claims, 2 Drawing Sheets

PHOTOMULTIPLIER SYSTEM AND A MICROSCOPE

Priority is claimed to U.S. Application Ser. No. 60/771,365, filed by applicants on Feb. 8, 2006, to German application DE 10 2005 006 695.8, filed on Feb. 23, 2005, and to German patent application DE 10 2005 019 647.0, filed on Apr. 26, 2005, the entire subject matters of all of which are hereby incorporated by reference herein.

The present invention relates to a photomultiplier system including a detector tube and a power supply unit for providing the accelerating voltage required to operate the detector tube. The present invention also relates to a microscope containing such a photomultiplier system.

BACKGROUND

Photomultiplier systems including a detector tube and a power supply unit for providing the accelerating voltage required to operate the detector tube are known in the field and exist in various forms. In one known photomultiplier system, as a detector tube, special electron tubes are used in order to amplify weak light signals, even to the point where individual photons are amplified, and to convert the same into an electrical signal. To this end, the detector tube usually contains a photocathode and a downstream secondary electron multiplier. Photons hit the photocathode and knock electrons out of the surface thereof. The released photoelectrons are accelerated in an electric field and hit further electrodes, each hitting electron knocking several secondary electrons out of the electrode surface. Thus, the number of electrons increases from electrode to electrode in a cascade-like fashion. At the end of the cascade, the electrons hit an anode and flow to ground. In this process, a voltage drop is generated across a resistance. This signal is coupled out for measurement. Typical detector tubes contain about 10 electrodes. The magnitude of the voltage pulse generated is proportional to the number of incident photons, i.e., to the intensity of the light. The required accelerating voltage is provided by a power supply unit.

Photomultiplier systems of this type are used, for example, in microscopes to detect detection light. In sensitive measurements, i.e., in measurements intended for the detection of weak light signals, it is problematic that the detector tube is often heated by the power supply unit, whereby background noise is generated in the detector tube, said background noise interfering with the measurement and reducing the detection sensitivity of the photomultiplier system.

In order to overcome this problem, the power supply unit could be disposed at a suitable distance from the detector tube to reduce the heating of the detector tube by the power supply unit. However, it is desirable that the spacing between the detector tube and the power supply unit be as small as possible to reduce measurement interference by external electrical noise and to minimize high-voltage wiring. However, the reduction in spacing in turn increases the risk for the detector tube to be heated by the power supply unit.

SUMMARY OF THE INVENTION

It is, therefore, an object of the present invention to provide a photomultiplier system and a microscope including a detector tube and a power supply unit for providing the accelerating voltage to operate the detector tube which will enable measurement of even very weak light signals using structurally simple means.

The present invention provides a photomultiplier system including a detector tube and a power supply unit for providing the accelerating voltage to operate the detector tube. The detector tube and the power supply unit are disposed on different sides of a thermal isolation element.

In accordance with the present invention, it was discovered that the spacing between the detector tube and the power supply unit in a photomultiplier system can indeed be kept small while still preventing, to the extent possible, heating of the detector tube by the power supply unit. Specifically, a thermal isolation element is provided for this purpose between the detector tube and the power supply unit. In other words, the detector tube and the power supply unit are disposed on different sides of a thermal isolation element. The thermal isolation element suppresses heat transfer from the power supply unit to the detector tube, it still being possible to keep the spacing between the detector tube and the power supply unit small in order to reduce external interference and to minimize high-voltage wiring between the power supply unit and the detector tube. Thus, the photomultiplier system of the present invention reduces background noise of the detector tube to the extent possible.

Therefore, the photomultiplier system provided by the present invention is a photomultiplier system which enables measurement of even very weak light signals using structurally simple means.

In an especially simple design, the isolation element could be plate-shaped. This, at the same time, allows for effective thermal isolation between the detector tube and the power supply unit.

In order to further improve the thermal isolation between the detector tube and the power supply unit, it would be possible to mount the power supply unit on a support member. The support member could provide thermal shielding of the detector tube.

Specifically, the power supply unit could be coupled to the isolation element mainly via the support member. In other words, the support member could be disposed between the power supply unit and the isolation element.

Further, in order to provide efficient thermal isolation and to prevent heat conduction from the power supply unit to the detector tube, the support member or the power supply unit could have a plurality of thin coupling elements for coupling to the isolation element and to provide a predeterminable distance between the support member or the power supply unit and the isolation element. In other words, the support member or the power supply unit could be mounted on the isolation element via such thin coupling elements, which make heat conduction more difficult. The length of the coupling elements can be selected according to the desired distance between the support member or the power supply unit and the isolation element.

Specifically, the coupling elements could take the form of thin bars or straps. The thinner the coupling elements or bars or straps, the lower is their thermal conductivity.

Further, in order for the heat transfer from the power supply unit to the detector tube to be as small as possible, the support member could have cooling fins. This would allow heat to be dissipated from the power supply unit to the outside through the support member.

In order to further reduce heat conduction from the power supply unit via the support member to the isolation element, and thus to the detector tube, the support member could be formed from a material having low thermal conductivity. For instance, the support member could be made from a ceramic material.

In addition to its thermal isolation function, the isolation element could take the form of a printed circuit board in order to achieve a particularly compact photomultiplier system. Thus, the isolation element could also have electric or electronic functions. In particular, the electrical connection between the power supply unit and the detector tube could be provided via the isolation element in the form of a printed circuit board.

Further advantageously, the printed circuit board could have a flexible region for connection to the power supply unit and/or to the support member. Such a flexible region also inhibits heat conduction between the power supply unit and the detector tube, it being possible for the power supply unit and the detector tube to be electrically interconnected via this flexible region.

In order to prevent unwanted heating of the detector tube, the power supply unit and/or the detector tube could have a cooling device associated therewith. Such a cooling device could be in the form of a passive cooling device. Specifically, the cooling device for the power supply unit could be implemented in the form of a housing cover or housing part or heat sink thermally coupled to the power supply unit. This allows the heat generated by the power supply unit to be dissipated before it is transferred to the detector tube.

In order to allow the heat of the power supply unit to be dissipated in a particularly effective manner, a thermal connection means having particularly high thermal conductivity could be disposed between the power supply unit and the housing cover or housing part or heat sink.

Alternatively, or in addition to a passive cooling device, the cooling device could also take the form of an active cooling device, or be provided with an active cooling device. Particularly advantageously, the cooling device could include a Peltier element for this purpose.

Further alternatively or in addition, the cooling device could take the form of a refrigerant or a water cooling system.

The present invention also provides a microscope, for example a confocal scanning microscope, including a photomultiplier system of the type described above disposed in a detection beam path. In this regard, and to avoid repetitions, reference is made to the explanations regarding the photomultiplier system of the present invention.

BRIEF DESCRIPTION OF THE DRAWINGS

The teaching of the present invention can be embodied and refined in different ways. The present invention is elaborated upon below based on an exemplary embodiment with reference to the drawings, in which.

DETAILED DESCRIPTION

Figure 1:
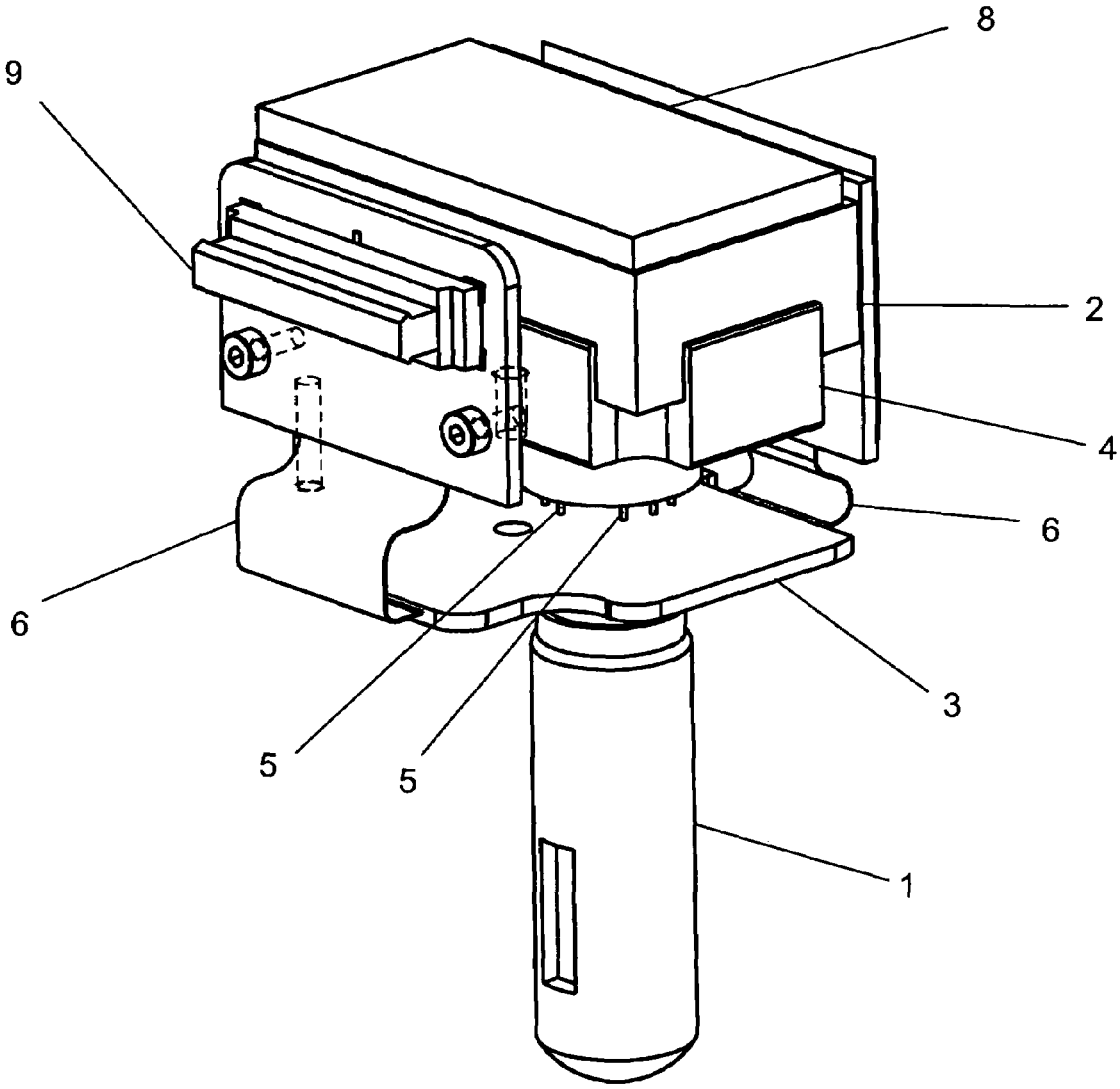
FIG. 1 is a perspective side view of an exemplary embodiment of a photomultiplier system according to the present invention.

FIG. 1 is a perspective side view of an exemplary embodiment of a photomultiplier system of the present invention, including a detector tube 1 and a power supply unit 2 for providing the accelerating voltage required to operate detector tube 1. In order to enable detection of even very weak light signals using structurally simple means, detector tube 1 and power supply unit 2 are disposed on different sides of a thermal isolation element 3.

Power supply unit 2 is mounted on a support member 4, which provides a barrier against heat radiation from power supply unit 2 toward isolation element 3 and detector tube 1. The coupling of power supply unit 2 to isolation element 3 is mainly via support member 4. In order to prevent significant heat transfer, support member 4 has a plurality of thin coupling elements 5 in the form of straps for coupling to isolation element 3. In this manner, a predeterminable distance is provided between power supply unit 2 and isolation element 3.

Specifically, isolation element 3 takes the form of a printed circuit board having two flexible regions 6 for connection to power supply unit 2. Such flexible regions 6 additionally hinder heat transfer and thermal diffusion from power supply unit 2 to the printed circuit board, and thus to detector tube 1.

Figure 2:
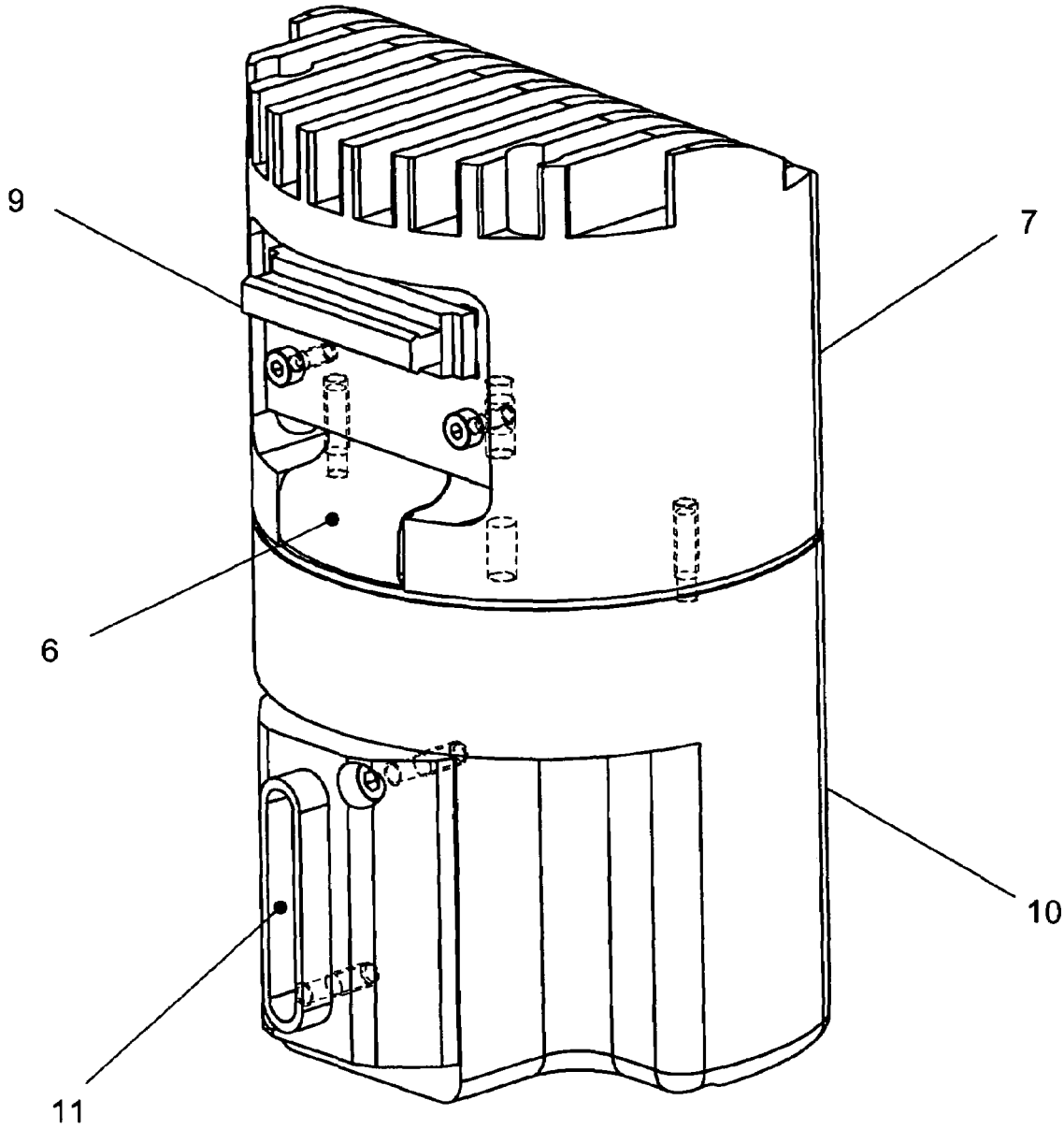
FIG. 2 shows the photomultiplier system of FIG. 1 in a suitable housing.

Power supply unit 2 and detector tube 1 can have cooling devices associated therewith. In the exemplary embodiment shown here, in addition to the spatial separation of detector tube 1 from power supply unit 2, which is provided by the printed circuit board or isolation element 3 in that power supply unit 2 is disposed on the upper side of the printed circuit board while detector tube 1 is disposed on the lower side thereof, the heat generated by power supply unit 2 can be dissipated through a housing cover 7, which is shown in FIG. 2. In order to provide heat conduction between power supply unit 2 and housing cover 7, a thermal connection means 8 is disposed on power supply unit 2.

For electrical connection, the photomultiplier system has a plug 9, via which various external connections can be made. In the photomultiplier system of the present invention, in spite of the thermal isolation of power supply unit 2 from detector tube 1, the spacing between these components is small.

FIG. 2 is a perspective side view showing the photomultiplier system disposed in a housing. In addition to housing cover 7, the housing has a lower housing part 10, which contains detector tube 1. The light to be detected is allowed to enter detector tube 1 through an entrance aperture 11 provided in lower housing part 10.

Plug 9 protrudes from housing cover 7. Housing cover 7 further has an opening for a flexible region 6 of the printed circuit board. In order to provide for efficient dissipation of the heat generated by power supply unit 2, housing cover 7 is provided with cooling fins. For purposes of cooling detector tube 1, it is possible to additionally use passive heat sinks or an active cooling device, for example, in the form of a Peltier element.

In the exemplary embodiment shown here, the small spacing between detector tube 1 and power supply unit 2 allows the use of short conductive traces for electrical interconnection. This reduces external interference.

With regard to further advantageous embodiments of the photomultiplier system and microscope according to the present invention, and to avoid repetitions, reference is made to the general part of the description and to the appended claims.

Finally, it is particularly noted that the exemplary embodiment described above is merely intended to illustrate the teaching claimed, but does not limit it to such exemplary embodiment.

What is claimed is:

1. A photomultiplier system comprising:

a detector tube;

a power supply unit configured to provide an accelerating voltage for operating the detector tube;

a thermal isolation element including a printed circuit board; and a support member, the power supply being disposed thereon, wherein the detector tube and the power supply unit are disposed each on a respective different side of the isolation element, and wherein the printed circuit board includes a flexible region configured to connect to at least one of the power supply unit and the support member.

2. The photomultiplier system as recited in claim 1 wherein the isolation element includes a plate-shape.

3. The photomultiplier system as recited in claim 1 wherein the power supply unit and the isolation element are coupled, the coupling being substantially via the support member.

4. The photomultiplier system as recited in claim 1 wherein at least one of the support member and the power supply unit includes a plurality of thin coupling elements configured to couple to the isolation element and to provide a predeterminable distance between the isolation element and the at least one of the support member and the power supply unit.

5. The photomultiplier system as recited in claim 4 wherein the coupling elements include a form of a thin bar or strap.

6. The photomultiplier system as recited in claim 1 wherein the support member includes a least one cooling fin.

7. The photomultiplier system as recited in claim 1 wherein the support member includes a material having a low thermal conductivity.

8. The photomultiplier system as recited in claim 1 wherein the support member includes a ceramic material.

9. The photomultiplier system as recited in claim 1 further comprising a cooling device associated with at least one of the power supply unit and the detector tube.

10. The photomultiplier system as recited in claim 9 wherein the cooling device includes a passive cooling device.

11. The photomultiplier system as recited in claim 9 wherein the cooling device is associated with the power supply unit and includes at least one of a housing cover, a housing part, and a heat sink thermally coupled to the power supply unit.

12. The photomultiplier system as recited in claim 11 further comprising a thermal connection device disposed between the power supply unit and at least one of the housing cover, the housing part, and the heat sink.

13. The photomultiplier system as recited in claim 9 wherein the cooling device includes an active cooling device.

14. The photomultiplier system as recited in claim 9 wherein the cooling device includes a Peltier element.

15. The photomultiplier system as recited in claim 9 wherein the cooling device includes a refrigerant or water cooling system.

16. A microscope comprising a photomultiplier system disposed in a detection beam path of the microscope, the photomultiplier system including:

a detector tube;

a power supply unit configured to provide an accelerating voltage for operating the detector tube;

a thermal isolation element including a printed circuit board; and a support member, the power supply being disposed thereon, wherein the detector tube and the power supply unit are disposed each on a respective different side of the isolation element, and wherein the printed circuit board includes a flexible region configured to connect to at least one of the power supply unit and the support member.

17. The microscope as recited in claim 16 wherein the detection beam path is configured to support confocal scanning.

18. A photomultiplier system comprising:

a detector tube;

a power supply unit configured to provide an accelerating voltage for operating the detector tube;

a thermal isolation element; and a support member, the power supply being disposed thereon, wherein the detector tube and the power supply unit are disposed each on a respective different side of the isolation element, and wherein the power supply unit and the isolation element are coupled, the coupling being substantially via the support member.

* * * * *